US009394922B2

(12) United States Patent
Williamson et al.

(10) Patent No.: US 9,394,922 B2
(45) Date of Patent: Jul. 19, 2016

(54) HYDRAULIC CONTROL CIRCUIT WITH REGENERATION VALVE

(71) Applicant: Caterpillar Global Mining LLC, Oak Creek, WI (US)

(72) Inventors: Christopher A. Williamson, Greendale, WI (US); Michael Chiaramonte, Cary, NC (US); Sean Johnson, Newark, IL (US); Justin Ayers, Peoria, IL (US); Robert Stone, Germantown Hills, IL (US); Brett J. Janson, Hanna City, IL (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 389 days.

(21) Appl. No.: 14/013,757

(22) Filed: Aug. 29, 2013

(65) Prior Publication Data

US 2015/0059568 A1 Mar. 5, 2015

(51) Int. Cl.
*F15B 11/024* (2006.01)
*E02F 9/22* (2006.01)

(52) U.S. Cl.
CPC ..... *F15B 11/024* (2013.01); *E02F 9/2217* (2013.01); *E02F 9/2296* (2013.01); *F15B 2211/20546* (2013.01); *F15B 2211/3058* (2013.01); *F15B 2211/3059* (2013.01); *F15B 2211/30555* (2013.01); *F15B 2211/327* (2013.01); *F15B 2211/6313* (2013.01); *F15B 2211/6658* (2013.01); *F15B 2211/7128* (2013.01)

(58) Field of Classification Search
CPC .. F15B 11/024; F15B 13/042; F15B 13/0442; F15B 21/14; F15B 2011/0243; F15B 2011/0246; F15B 2211/50563; F15B 2211/3133; F15B 2211/20546; F15B 2211/30555; F15B 2211/7128; F15B 2211/3059; F15B 2211/327; F15B 2211/6313; F15B 2211/6658; F15B 2211/3058; E02F 9/2217
See application file for complete search history.

(56) References Cited

U.S. PATENT DOCUMENTS

| | | | | |
|---|---|---|---|---|
| 6,715,403 | B2 | 4/2004 | Hajek et al. | |
| 7,168,245 | B2 * | 1/2007 | Thunes | B62D 5/30 60/403 |
| 7,210,396 | B2 * | 5/2007 | Kuehn | E02F 9/2228 60/461 |
| 7,219,592 | B2 | 5/2007 | Nielsen et al. | |

(Continued)

FOREIGN PATENT DOCUMENTS

| | | |
|---|---|---|
| CN | 102588362 | 7/2012 |
| CN | 202767158 | 3/2013 |

(Continued)

*Primary Examiner* — Thomas E Lazo
*Assistant Examiner* — Logan Kraft

(57) ABSTRACT

A hydraulic circuit for controlling a component of a hydraulic machine includes an actuator having a head end chamber and a rod end chamber, the actuator having an extended position for moving the component in a first direction and a retracted position for moving the component in a second direction. The hydraulic circuit includes a regeneration valve having an open position for fluidly connecting the head end chamber to the rod end chamber, a first control valve having a first open position, a second open position for fluidly connecting the regeneration valve to the return tank and substantially fluidly disconnecting the rod end chamber from the fluid source, and a closed position, and a second control valve having a first open position, a second open position, and a closed position for substantially fluidly disconnecting the rod end chamber from the fluid source.

17 Claims, 7 Drawing Sheets

(56) References Cited

U.S. PATENT DOCUMENTS

| | | | | |
|---|---|---|---|---|
| 7,243,591 | B2 | 7/2007 | Dixen et al. | |
| 7,337,807 | B2 | 3/2008 | Koo et al. | |
| 7,634,911 | B2 * | 12/2009 | Brinkman | E02F 9/2075 60/414 |
| 9,086,061 | B2 * | 7/2015 | Zhang | F04B 49/002 |

FOREIGN PATENT DOCUMENTS

| | | |
|---|---|---|
| DE | 1020080 64 064 | 6/2010 |
| JP | 09287172 | 11/1997 |
| JP | 2013040641 | 2/2013 |
| WO | WO 2010/069473 | 6/2010 |

* cited by examiner

HYDRAULIC CONTROL CIRCUIT WITH REGENERATION VALVE

TECHNICAL FIELD

This disclosure relates to control systems for hydraulic machines, and particularly to control systems having a regeneration function or mode.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Hydraulic machines typically include a hydraulic control system for routing hydraulic fluid to one or more components of the machine. The hydraulic control system routes pressurized hydraulic fluid to each component, providing a force (i.e., hydraulic power) to move or otherwise control the component. Hydraulic excavators, for instance, typically include a boom that is raised and lowered by pressurized hydraulic fluid routed through a hydraulic control system, such as to move an attached bucket (e.g., dipper, shovel, etc.) for digging. The pressurized fluid is often provided by a hydraulic pump and routed to hydraulic cylinders that are coupled to the boom and configured to extend or retract in order to raise and/or lower the boom. In an industrial setting such as a mining or construction site, the hydraulic excavator may be required to raise and lower the boom repeatedly, requiring pressurized fluid to be pumped to the hydraulic cylinders each time the boom is raised or lowered. The hydraulic pump is often powered by a motor or engine, which may require fuel or other energy in order to power the pump.

Some hydraulic machines may include control systems or circuits having a regeneration function intended to supply fluid to a hydraulic component without discharging additional fluid from the hydraulic pump. An example of such a control system can be found in U.S. Pat. No. 7,337,807, issued Mar. 4, 2008, for "Hydraulic Control Valve with Regeneration Function," which discloses a hydraulic control valve "capable of maintaining the pressure in a regeneration fluid passage" despite changes in the discharge flow rate of the hydraulic pump. However, the disclosed control valve includes a regeneration valve that is installed within the control valve, resulting in significant design and installation costs in order to implement the regeneration function into existing machines. In addition, the disclosed control valve requires additional components in order to implement the regeneration function, including a regeneration fluid passage for storing a supply of regeneration fluid and a separate return line connected to the hydraulic tank. The additional components require additional maintenance, replacement and other costs, and require additional space within the machine for routing the components.

SUMMARY

An embodiment of the present disclosure relates to a hydraulic circuit for controlling a component of a hydraulic machine. The hydraulic circuit includes an actuator having a head end chamber and a rod end chamber, the actuator having an extended position for moving the component in a first direction and a retracted position for moving the component in a second direction. The hydraulic circuit includes a regeneration valve having an open position for fluidly connecting the head end chamber to the rod end chamber and a closed position for substantially fluidly disconnecting the head end chamber and the rod end chamber. The hydraulic circuit also includes a first control valve having a first open position for fluidly connecting the head end chamber to a fluid source and fluidly connecting the rod end chamber to a return tank, a second open position for fluidly connecting the head end chamber and the regeneration valve to the return tank and substantially fluidly disconnecting the rod end chamber from the fluid source, and a closed position for substantially fluidly disconnecting the rod end chamber from the fluid source and the return tank. Further, the hydraulic circuit includes a second control valve having a first open position for fluidly connecting the head end chamber to the fluid source and fluidly connecting the rod end chamber to the return tank, a second open position for fluidly connecting the rod end chamber to the fluid source and the head end chamber to the return tank, and a closed position for substantially fluidly disconnecting the rod end chamber from the fluid source and the return tank.

Another embodiment of the present disclosure relates to an apparatus having a hydraulic component movable in a first direction and a second direction. The apparatus includes an actuator coupled to the hydraulic component and having a head end chamber and a rod end chamber, the actuator having an extended position for moving the hydraulic component in the first direction and a retracted position for moving the hydraulic component in the second direction, a fluid source for selectively providing pressurized fluid to the actuator, and a hydraulic circuit for fluidly connecting the fluid source to the actuator. The hydraulic circuit includes a regeneration valve having an open position for fluidly connecting the head end chamber to the rod end chamber and a closed position for substantially blocking a fluid flow between the head end chamber and the rod end chamber, a first control valve having a first open position for fluidly connecting the head end chamber to the fluid source and fluidly connecting the rod end chamber to a return tank, a second open position for fluidly connecting the head end chamber and the regeneration valve to the return tank and substantially fluidly disconnecting the rod end chamber from the fluid source, and a closed position for substantially fluidly disconnecting the rod end chamber from the fluid source and the return tank, and a second control valve having a first open position for fluidly connecting the head end chamber to the fluid source and fluidly connecting the rod end chamber to the return tank, a second open position for fluidly connecting the rod end chamber to the fluid source and the head end chamber to the return tank, and a closed position for substantially fluidly disconnecting the rod end chamber from the fluid source and the return tank.

Another embodiment of the present disclosure relates to a control module for controlling a hydraulic circuit having an actuator coupled to a hydraulic component for moving the hydraulic component in a first direction and a second direction and including a head end chamber and a rod end chamber. The control module includes a processor for receiving and processing a command from an operator input device to move the hydraulic component in the first direction or the second direction, a memory for storing the command, and a power supply for providing power to the processor and the memory. The processor is programmed to receive the command from the operator input device, calculate an actuator pressure differential, and when the command includes moving the hydraulic component in the first direction to move the hydraulic circuit to a boom raise configuration. The processor is also programmed to when the command includes moving the hydraulic component in the second direction and the actuator pressure differential is greater than a specified regeneration pressure threshold, move the hydraulic circuit to a regenerating boom lower configuration until the actuator pressure differential is less than a minimum regeneration pressure threshold or a new command is received. The processor is further programmed to when the command includes moving the hydraulic component in the second direction and the actuator pressure differential is less than or equal to the specified regeneration pressure threshold, move the hydraulic circuit to a powered boom lower configuration until the actuator pressure differential is less than a maximum regeneration pressure threshold or a new command is received.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
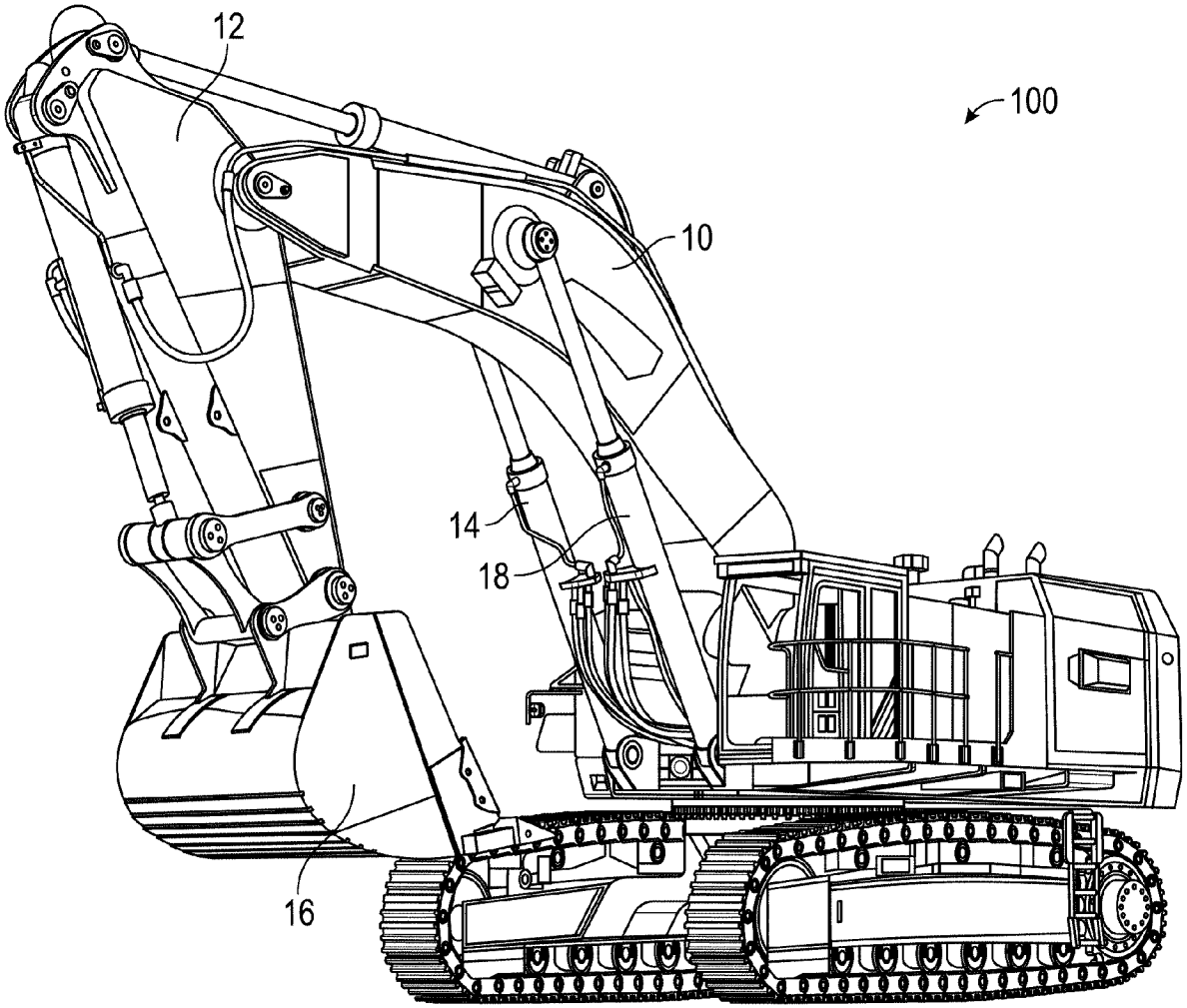
FIG. 1 is a perspective view of a hydraulic excavator, according to an exemplary embodiment.

Referring to FIG. 1, a hydraulic excavator 100 is shown, according to an exemplary embodiment. In this embodiment, the hydraulic excavator 100 includes a bucket 16 (e.g., shovel, dipper, etc.) coupled to a boom 10. The boom 10 may be raised, lowered, or otherwise moved or controlled in order to perform various functions of the hydraulic excavator 100, such as to move the bucket 16 into a position for digging.

In the illustrated embodiment of FIG. 1, the hydraulic excavator 100 includes a first actuator 14 and a second actuator 18 each coupled to the boom 10 and configured to control a movement of the boom 10 in a single direction (e.g., to raise and lower the boom 10). The actuators 14 and 18 may be hydraulic cylinders or any other suitable implement device used for raising, lowering, or tilting parts of a machine, such as the hydraulic excavator 100. The actuators 14 and 18 control movement of the boom 10 by extending and retracting in order to raise and/or lower the boom 10 (and thus the bucket 16). The hydraulic excavator 100 includes two actuators (i.e., actuators 14 and 18) for raising and lowering the boom 10 in the illustrated embodiment of FIG. 1, but the hydraulic excavator 100 may include other similar actuators for otherwise moving the boom 10, or for controlling movement of other components of the hydraulic excavator 100. In other embodiments, the hydraulic excavator 100 may include more or fewer actuators in order to raise and lower the boom 10, or to otherwise control the boom 10 and/or other components of the hydraulic excavator 100. The actuator 14 is positioned on a first side of the boom 10 and the actuator 18 is positioned on a second side of the boom 10 in order to balance the weight of the boom 10. In an exemplary embodiment, the actuators 14 and 18 move substantially in unison in order to provide the force necessary to raise or lower the boom 10. However, in other embodiments the actuators 14 and 18 may move separately in order raise, lower, or otherwise move the boom 10, as may be suitable for the particular application of the hydraulic excavator 100 and/or the hydraulic control circuit 20. In an exemplary embodiment, the hydraulic excavator 100 includes an operator input device, such as a joystick or a touchscreen panel, for an operator to enter a command or other input in order to cause a movement of the boom 10 and/or another component of the hydraulic excavator 100. In this embodiment, the actuators 14 and 18 may be configured and enabled to move in response to the command or input, such as to raise or lower the boom 10.

Referring now to FIGS. 2-5, a hydraulic control circuit 20 (e.g., boom control circuit, hydraulic control circuit, etc.) is shown in various modes of operation for the hydraulic control circuit 20, according to an exemplary embodiment. The hydraulic control circuit 20 is shown in the Figures and described below for use within the hydraulic excavator 100 in order to raise and lower the boom 10. However, the hydraulic control circuit 20 may be used to control another component of the hydraulic excavator 100, such as the bucket 16 or a stick 12, or the hydraulic excavator 100 may include multiple hydraulic control circuits 20 for controlling more than one component of the hydraulic excavator 100. Similarly, the hydraulic control circuit 20 may be used to control one or more hydraulic components of another type of hydraulic machine, as may be suitable for the particular application.

Figure 2:
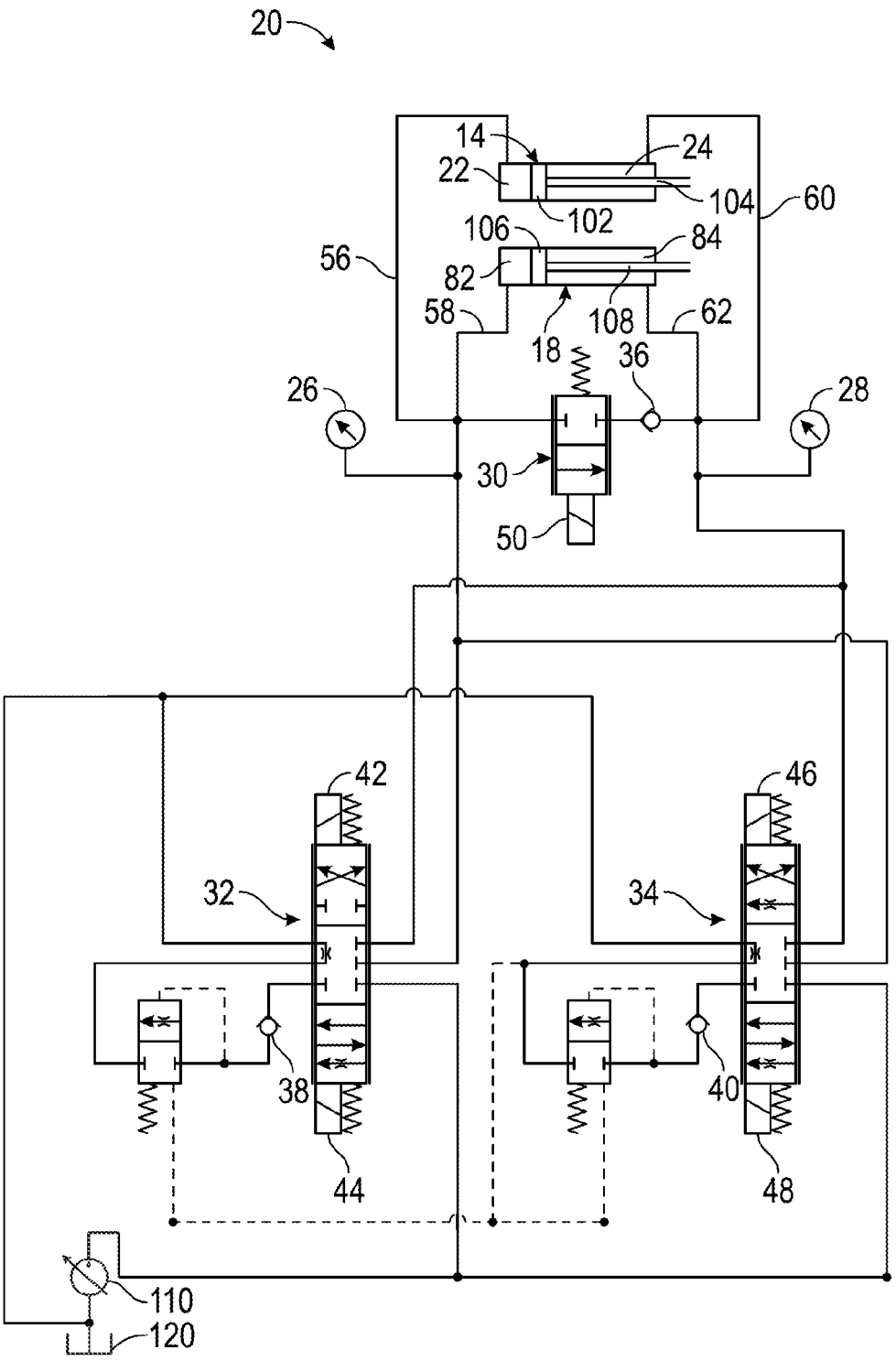
FIG. 2 is a simplified schematic view of a hydraulic circuit for controlling a boom of the hydraulic excavator of FIG. 1, according to an exemplary embodiment.

In the illustrated embodiment of FIGS. 2-5, the hydraulic control circuit 20 is shown to include the actuators 14 and 18. In FIG. 2, the hydraulic control circuit 20 is shown for an operating condition where the boom 10 is at rest (i.e., neither being raised or lowered), but in other configurations or modes the hydraulic control circuit 20 is used to control or move the boom 10. The hydraulic control circuit 20 controls the flow of hydraulic fluid to the actuators 14 and 18, selectively routing pressurized hydraulic fluid to the actuators 14 and 18 in order to provide hydraulic power to move the boom 10. The hydraulic fluid may be supplied by a fluid source such as hydraulic pump 110, with the hydraulic control circuit 20 fluidly connecting the actuators 14 and 18 to the fluid source as necessary or useful for the particular application of the hydraulic control circuit 20. The fluid may also be routed from one or more components of the hydraulic control circuit 20. In the illustrated embodiment, the actuator 14 includes a head end chamber 22 and a rod end chamber 24. The head end chamber 22 and the rod end chamber 24 are separated by a piston 102 having a piston rod 104. The actuator 18 includes a head end chamber 82 and a rod end chamber 84 separated by a piston 106 having a piston rod 108. In this embodiment, pressurized fluid may be routed to the head end chambers 22 and 82 by the hydraulic control circuit 20 in order to extend the pistons 102 and 106 (i.e., extend the actuators 14 and 18) and raise the boom 10. Conversely, pressurized fluid may be routed to the rod end chambers 24 and 84 by the hydraulic control circuit 20 in order to retract the pistons 102 and 106 (i.e., retract the actuators 14 and 18) and lower the boom 10.

In this embodiment, the hydraulic control circuit 20 includes a pressure sensor assembly shown as pressure sensors 26 and 28 (e.g., pressure transducer, pressure transmitter, pressure indicator, etc.) for monitoring fluid pressure within the actuators 14 and 18. The pressure sensor 26 monitors a fluid pressure (i.e., a head end fluid pressure, a first fluid pressure) at the head end chambers 22 and 82. The pressure sensor 28 monitors a fluid pressure (i.e., rod end fluid pressure, a second fluid pressure) at the rod end chambers 24 and 84. In one embodiment, the pressure sensors 26 and 28 monitor an absolute fluid pressure of the actuators 14 and 18 (e.g., the actual fluid pressure within the actuators 14 and 18). In another embodiment, the pressure sensors 26 and 28 monitor a relative pressure of the actuators 14 and 18 (e.g., a difference in fluid pressure between the head end chambers 22 and 82 and the rod end chambers 24 and 84, respectively). The pressure sensors 26 and 28 generate one or more signals representing a fluid pressure (e.g., absolute fluid pressure, relative fluid pressure, etc.) measured by the pressure sensors 26 and 28. The pressure sensors 26 and 28 are configured to transmit or send the signals, such as remotely to another component of the hydraulic excavator 100. In an exemplary embodiment, the pressure sensors 26 and 28 are configured to transmit the signals to a controller such as control module 90 (shown in FIG. 6) for use in controlling the hydraulic control circuit 20 and/or one or more components of the hydraulic excavator 100.

The pressure sensors 26 and 28 are fluidly connected to the actuators 14 and 18 by fluid lines in order to measure or monitor the fluid pressure within the actuators 14 and 18. In the illustrated embodiment of FIGS. 2-5, the pressure sensor 26 is fluidly connected to the head end chambers 22 and 82 by fluid lines 56 and 58, respectively, and the pressure sensor 28 is fluidly connected to the rod end chambers 24 and 84 by fluid lines 60 and 62, respectively. However, in other embodiments the pressure sensors 26 and 28 may be otherwise located in order to measure or monitor fluid pressure within the actuators 14 and 18. For instance, the pressure sensors 26 and 28 may be located or positioned within the actuators 14 and/or 18 or otherwise coupled to the actuators 14 and/or 18 in order to measure or monitor the fluid pressure within the actuators 14 and 18. The pressure sensor assembly may include multiple pressure sensors for monitoring a fluid pressure in one or more locations, as shown in the illustrated embodiment of FIGS. 2-5, or may include a single sensor for monitoring one or more fluid pressures in multiple locations.

The hydraulic control circuit 20 also includes a regeneration valve 30 for fluidly connecting the head end chambers 22 and 82 to the rod end chambers 24 and 84. The regeneration valve 30 has a closed position (shown in FIG. 2) for substantially preventing the flow of fluid between the head end chambers 22 and 82 and the rod end chambers 24 and 84 (e.g., fluidly disconnecting the head end chambers 22 and 82 and the rod end chambers 24 and 84). In an exemplary embodiment, the regeneration valve 30 remains closed (i.e., in the closed position) until actuated (e.g., energized, triggered, etc.). When actuated, the regeneration valve 30 opens (i.e., is moved to an open position such as the open position of FIG. 5) to allow fluid to flow from the head end chambers 22 and 82 to the rod end chambers 24 and 84 through the regeneration valve 30. In an exemplary embodiment, the regeneration valve 30 includes a plurality of open positions for allowing fluid to travel through the regeneration valve 30. In this embodiment, the regeneration valve 30 includes a fluid opening which can be selectively increased or decreased in size (e.g., upon receiving a signal from control module 90) in order to allow a greater or lesser amount of fluid to flow through the regeneration valve 30, such as to increase or decrease the force applied to the actuators 14 and 18.

In the illustrated embodiment of FIGS. 2-5, the regeneration valve 30 includes a solenoid 50 (i.e. actuator) for opening and/or closing the regeneration valve 30. The solenoid 50 is configured to receive an electric current, raising a current level of the solenoid 50 in order to control the regeneration valve 30 (i.e., move the regeneration valve 30 between the closed position and a plurality of open positions). In the illustrated embodiment of FIGS. 2-5, the regeneration valve 30 is "normally closed," remaining in the closed position until the solenoid 50 is energized with electric current, but in other embodiments the regeneration valve 30 may remain open (i.e., be normally opened) until the solenoid 50 is energized to close the valve 30. When a sufficient electric current is applied to the solenoid 50 (i.e., when the current level of the solenoid 50 reaches a first threshold current level), the solenoid 50 generates a force to open the regeneration valve 30 in order to allow fluid from the head end chambers 22 and 82 to flow through the regeneration valve 30. In an exemplary embodiment, the size of the fluid opening in the regeneration valve 30 (and thus the amount of fluid allowed to pass through the regeneration valve 30) is relative to the amount of electric current applied to the solenoid 50, with the fluid opening increasing as the amount of electric current applied to the solenoid 50 increases. For instance, the regeneration valve 30 may move from the closed position when a first threshold current level is reached to create a fluid opening. The fluid opening may then increase as the current level in the solenoid 50 increases, reaching a maximum fluid opening when a second threshold current level is present within the solenoid 50. Likewise, the fluid opening may decrease as the current level in the solenoid 50 decreases, moving or releasing the regeneration valve 30 to the closed position when the current level in the solenoid 50 lowers below the first threshold current level. In embodiments in which the regeneration valve 30 is normally opened, the size of the fluid opening may be decreased as the current level is increased.

When the regeneration valve 30 is in one of the plurality of open positions, pressurized hydraulic fluid is routed from the head end chambers 22 and 82 through the open regeneration valve 30. The fluid passing through the regeneration valve 30 is blocked by a check valve 36 until the fluid reaches a fluid pressure threshold (i.e., a first fluid pressure threshold), forcing open the check valve 36 and allowing the fluid to flow to the rod end chambers 24 and 84. Once the electric current within the solenoid 50 lowers below the first threshold current level, the regeneration valve 30 closes to substantially block the flow of hydraulic fluid between the head end chambers 22 and 82 and the rod end chambers 24 and 84. For instance, when a sufficient amount of fluid is routed to the rod end chambers 24 and 84, the regeneration valve 30 may be automatically closed by the control module 90. Although the regeneration valve 30 is shown as a solenoid valve in the illustrated embodiment of FIGS. 2-5, in other embodiments the regeneration valve 30 may be or include another type of valve (e.g., servo valve, etc.) configured to open and/or close to control the flow of hydraulic fluid between the head end chambers 22 and 82 and the rod end chambers 24 and 84, as may be suitable for the particular application of the hydraulic control circuit 20 and/or the hydraulic excavator 100.

Figure 3:
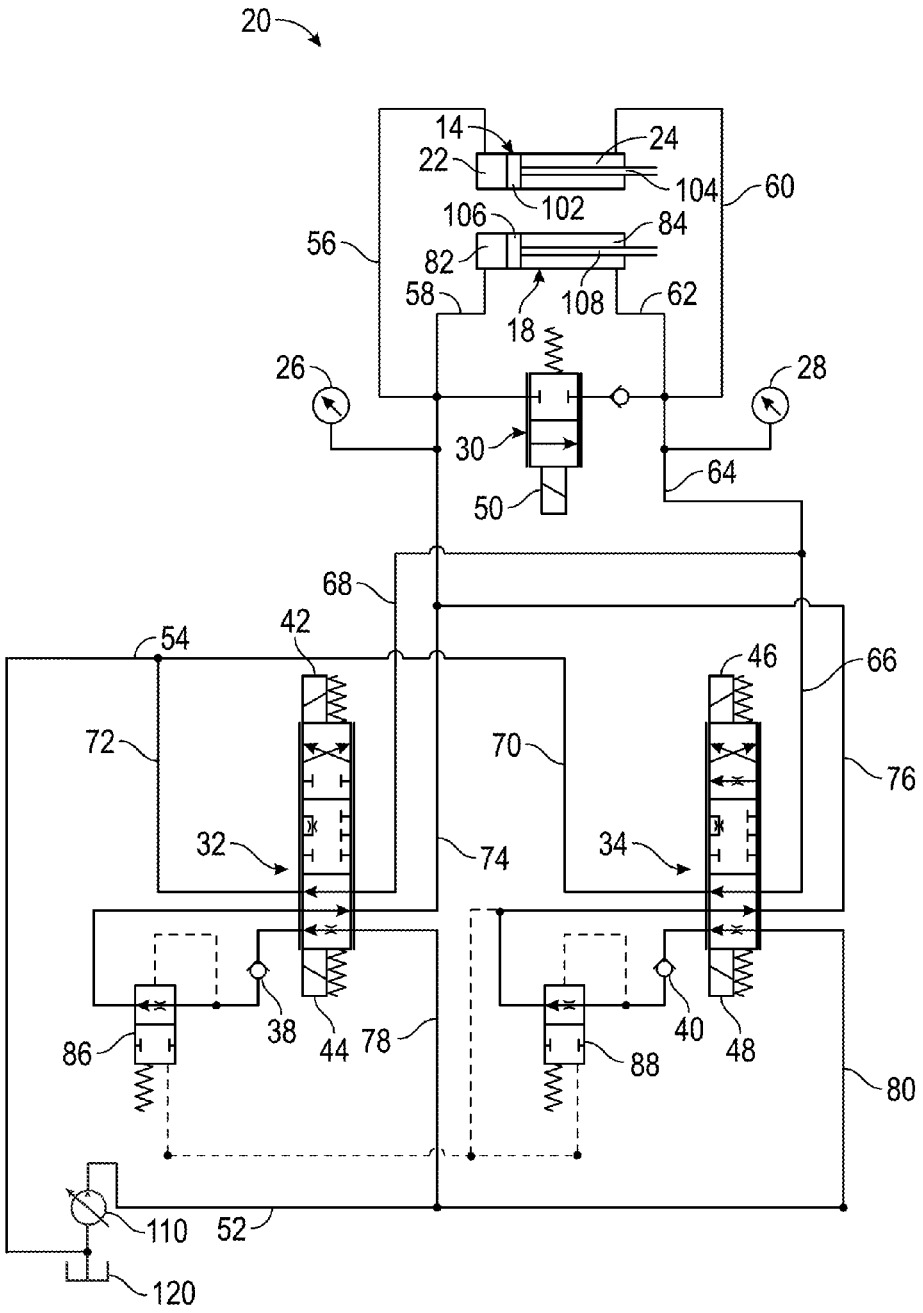
FIG. 3 is a simplified schematic view of the hydraulic circuit of FIG. 2 for when the boom is raised, according to an exemplary embodiment.
Figure 4:
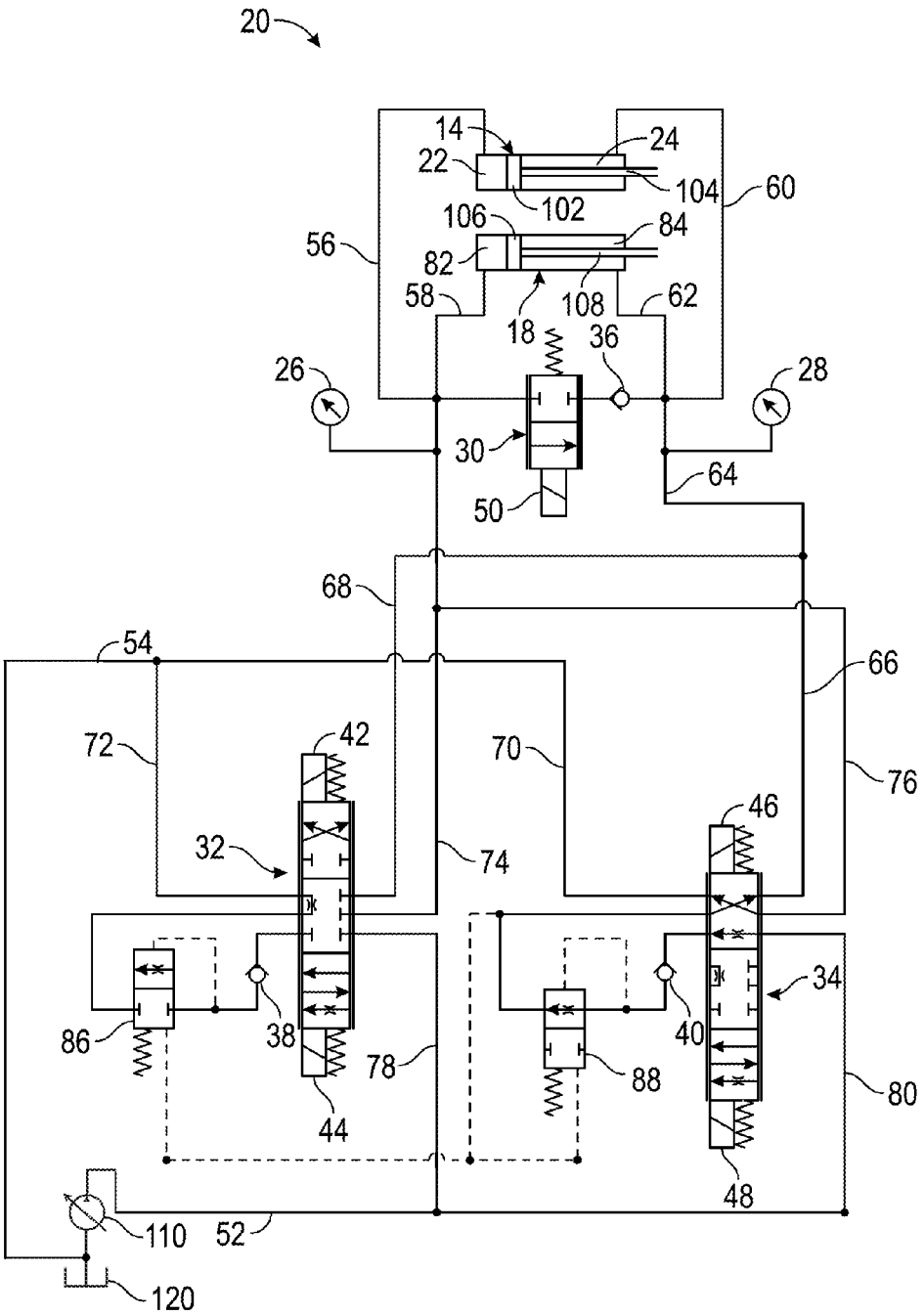
FIG. 4 is a simplified schematic view of the hydraulic circuit of FIG. 2 for when the boom is lowered using hydraulic power, according to an exemplary embodiment.
Figure 5:
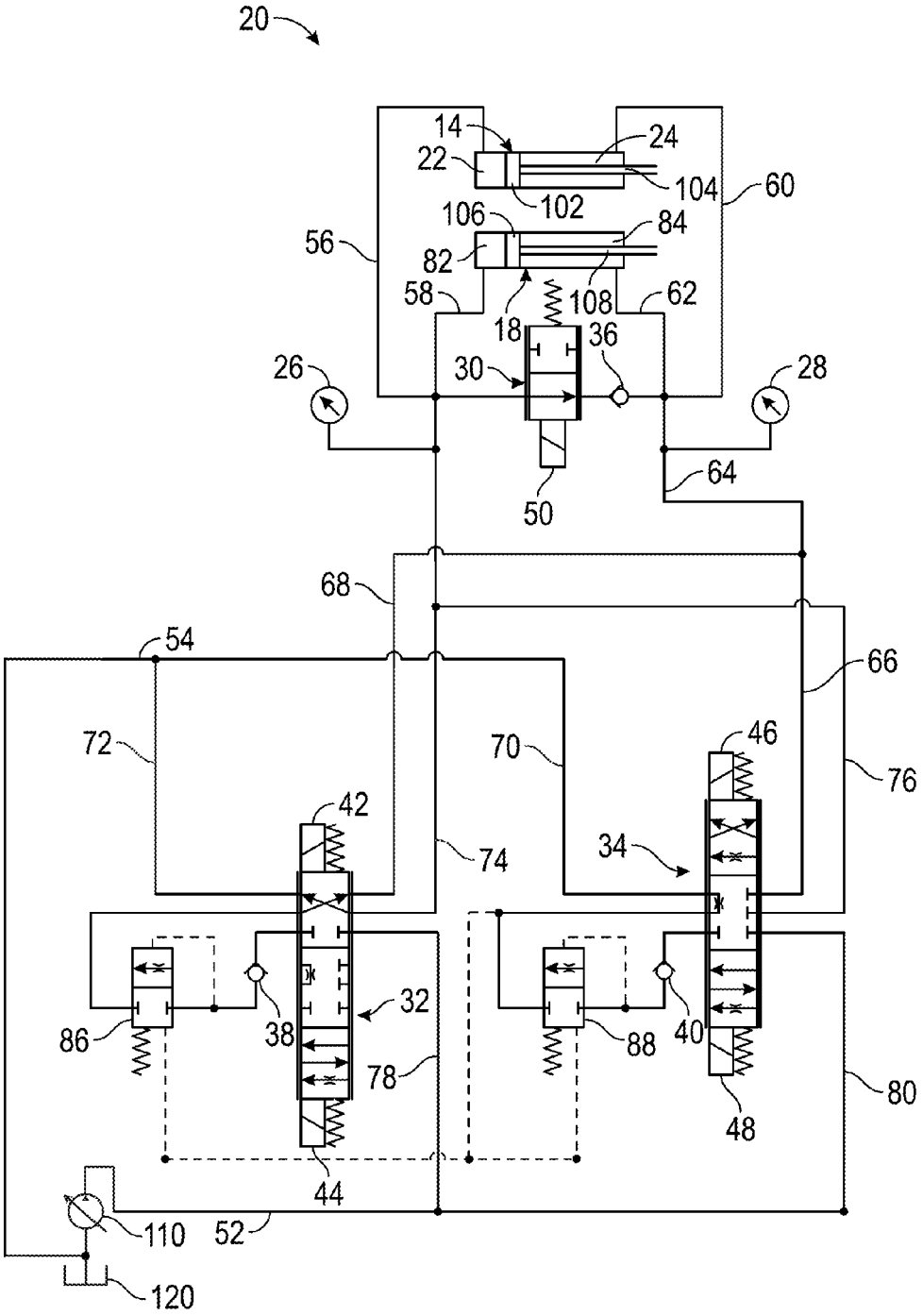
FIG. 5 is a simplified schematic view of the hydraulic circuit of FIG. 2 for when the boom is lowered by its own weight, according to an exemplary embodiment.

The hydraulic control circuit 20 also includes a first control valve shown as control valve 32 and a second control valve shown as control valve 34. The control valves 32 and 34 are configured to move between a closed position (shown in FIG. 2) and a plurality of open positions, some of which are shown in FIGS. 3-5. In the open positions, the control valves 32 and 34 fluidly connect the actuators 14 and 18 to the hydraulic pump 110, selectively routing the hydraulic fluid to the actuators 14 and 18 and throughout the hydraulic control circuit 20. The control valves 32 may also fluidly connect the actuators 14 and 18 to a hydraulic tank 120 (i.e., return tank) for recycling the hydraulic fluid. In a closed position, on the other hand, the control valves 32 and 34 block the flow of hydraulic fluid between the actuators 14 and 18, the hydraulic pump 110, and the hydraulic tank 120 (e.g., fluidly disconnect the actuators 14 and 18 from the hydraulic pump 110 and the hydraulic tank 120). In FIG. 2, for instance, the control valve 32 is shown in a closed position and the control valve 34 is shown in a closed position, blocking the flow of hydraulic fluid through the control valves 32 and 34. In an exemplary embodiment, the control valves 32 and 34 prevent hydraulic fluid from entering the hydraulic control circuit 20 and reaching the actuators 14 and 18 when the control valves 32 and 34 are in the closed position.

According to the illustrated embodiment of FIGS. 2-5, the control valves 32 and 34 are solenoid-operated valves. In this embodiment, the control valve 32 includes solenoid 42 and solenoid 44 and the control valve 34 includes solenoid 46 and solenoid 48. In an exemplary embodiment, the control valves 32 and 34 are normally closed in a de-energized state and the solenoids 42, 44, 46, and 48 are energized by an electric current to move the control valves 32 and/or 34 to one of various open positions (i.e., to open the control valves 32 and/or 34) in order to allow hydraulic fluid to pass through one or more fluid openings of the control valves 32 and 34 (e.g., from the hydraulic pump 110, to the hydraulic tank 120, etc.). In other embodiments, the control valves 32 and 34 may be or include another type of valve configured to open and/or close in order to control the flow of hydraulic fluid, as may be suitable for the particular application of the hydraulic control circuit 20.

In an exemplary embodiment, the solenoids 42, 44, 46, and 48 are configured to receive an electric current, raising a "current level" (i.e., amount or level of electric current) of the solenoids 42, 44, 46, and/or 48. The electric current may be applied or provided to one or more of the solenoids 42, 44, 46, and/or 48 in order to control the control valves 32 and 34 (i.e., move the control valves 32 and/or 34 between a closed position and a plurality of open positions). In the illustrated embodiment of FIGS. 2-5, when a sufficient electric current is applied to one of the solenoids 42, 44, 46, or 48 (i.e., when the current level of one of the solenoids 42, 44, 46, or 48 reaches a threshold current level), the energized solenoid 42, 44, 46, or 48 generates a sufficient force to open the associated control valve 32 or 34 (i.e. creating a fluid opening), allowing hydraulic fluid to travel through the control valve 32 or 34. In this embodiment, the control valves 32 and 34 are normally closed, remaining in the closed positions of FIG. 2 until at least one of the solenoids 42, 44, 46, or 48 are sufficiently energized with electric current, but in other embodiments the control valves 32 and/or 34 may remain open until the solenoids 42, 44, 46, and/or 48 are sufficiently energized to close the control valves 32 and/or 34. In an exemplary embodiment, the size of the fluid opening in the control valve 32 or 34 (and thus the amount of fluid allowed to pass through the control valve 32 or 34) is variable and determined by the amount of electric current applied to the solenoid 42, 44, 46, or 48, with the size of the fluid opening increasing as the amount of electric current applied to the solenoid 42, 44, 46, or 48 increases until a maximum fluid opening is reached. In this embodiment, when a greater amount of electric current is applied to the solenoid 42, 44, 46, or 48, the solenoid 42, 44, 46, or 48 applies a greater force to the associated control valve 32 or 34, creating a larger fluid opening in the control valve 32 or 34. Likewise, the fluid opening may decrease as the current level in the solenoid 42, 44, 46, or 48 decreases.

The hydraulic control circuit 20 also includes check valve 38 fluidly connected to the control valve 32 and check valve 40 fluidly connected to the control valve 34. In an exemplary embodiment, the check valves 38 and 40 are load-holding check valves for preventing unwanted movement of the actuators 14 and 18 (e.g., movement without command). In this embodiment, the check valves 38 and 40 are one-way valves that substantially block the flow of fluid through the check valves 38 and 40 in a first direction (e.g., bottom to top according to FIGS. 2-5), substantially preventing hydraulic fluid from flowing backward through the control valves 32 and/or 34 (e.g., left to right according to FIGS. 2-5) from the actuators 14 and/or 18 when the control valves 32 and/or 34 are in an open position. Without the check valves 38 and 40, for instance, hydraulic fluid could flow from the actuators 14 and 18 to the hydraulic pump 110 when the control valves 32 and/or 34 open to raise the boom 10. As fluid travels from the actuators 14 and 18 to the hydraulic pump 110, the fluid pressure at the hydraulic pump 110 (i.e., pump pressure) may increase until the pump pressure is approximately equal to the fluid pressure at the actuators 14 and 18, potentially causing or allowing the boom 10 to drift or move without command. The check valves 38 and 40 are intended to prevent fluid from flowing backward through the control valves 32 and/or 34 (i.e., left to right according to FIGS. 2-5), ensuring that the actuators 14 and 18 only move in the desired or commanded direction.

The check valves 38 and 40 are also intended to substantially block the flow of fluid through the check valves 38 and 40 in a second direction (e.g., top to bottom according to FIGS. 2-5) until the fluid pressure of the hydraulic fluid reaches a threshold fluid pressure. In an exemplary embodiment, the check valves 38 and 40 are in a closed position when the hydraulic control circuit 20 is at rest (shown in FIG. 2), substantially blocking the flow of fluid in the second direction. When the fluid pressure at the check valves 38 and/or 40 reaches the threshold fluid pressure in this embodiment, the check valves 38 and/or 40 are moved (e.g., by the fluid pressure) to an open position, allowing fluid to flow through the open check valves 38 and/or 40 and to the actuators 14 and 18. For instance, when the control valve 32 is in a first open position shown in FIG. 3, hydraulic fluid is allowed to flow from the hydraulic pump 110, through the control valve 32, and to the check valve 38. The check valve 38 is closed when the control valve 32 is initially opened, blocking the flow of hydraulic fluid and causing a fluid pressure to build at the check valve 38 as the hydraulic fluid continues to flow through the control valve 32. When the fluid pressure reaches the threshold fluid pressure, the check valve 38 is opened (e.g., by the fluid pressure) to allow the hydraulic fluid to flow to the actuators 14 and/or 18. The check valve 40 operates similarly, blocking the flow of hydraulic fluid from the open control valve 34 (e.g., from the hydraulic pump 110) until the fluid reaches a threshold fluid pressure.

Figure 6:
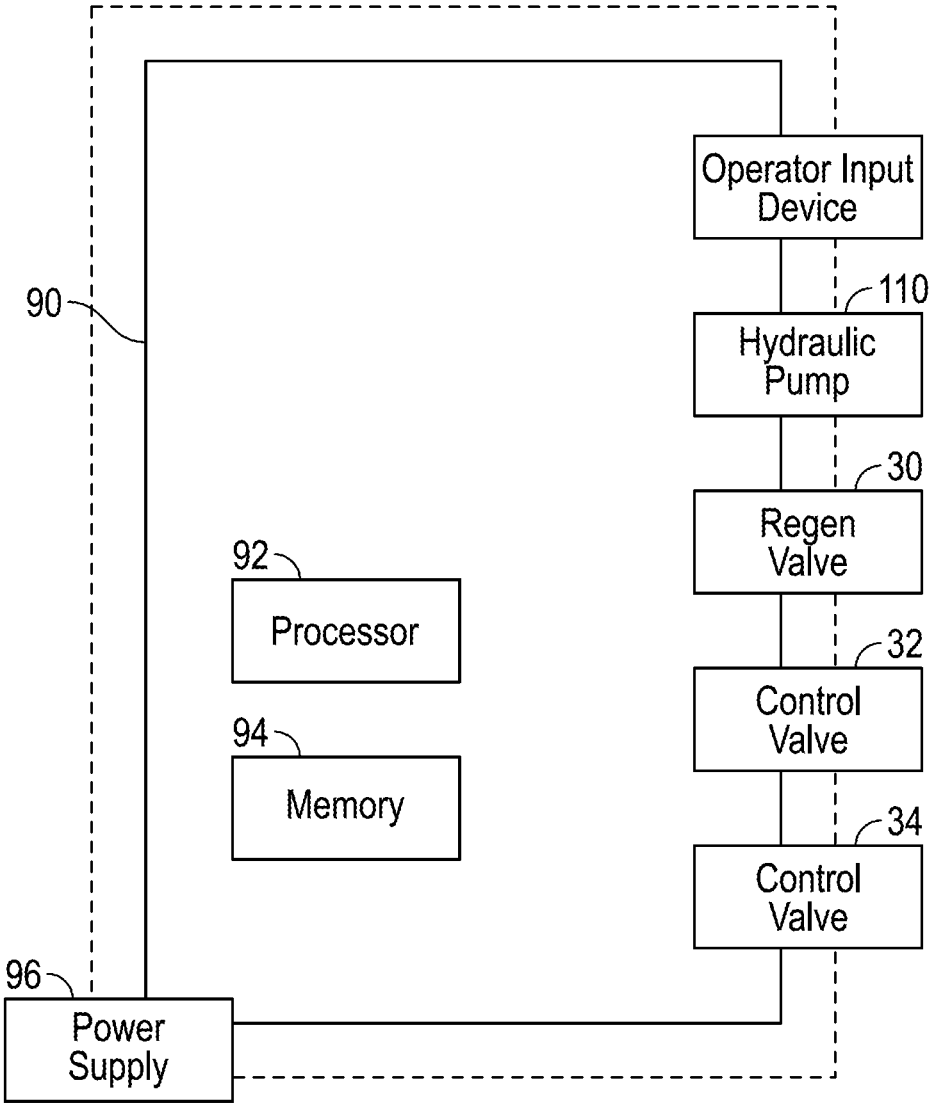
FIG. 6 is a schematic view of a control module for a hydraulic excavator, according to an exemplary embodiment.

In an exemplary embodiment, an electric current is sent through the solenoids 42, 44, 46, 48, and/or 50 in response to a signal or command from a controller such as control module 90 (shown in FIG. 6). In this embodiment, the control module 90 is coupled to one or more components of the hydraulic control circuit 20 and/or other components of the hydraulic excavator 100 and configured to communicate (e.g., send or receive signals) with the components. For instance, the control module 90 may receive input from one or more components of the hydraulic excavator 100, sending a signal or command to sufficiently energize one or more of the solenoids 42, 44, 46, 48, and 50 to open one or more valves 30, 32, and/or 34 based on the input received from the one or more components. In an exemplary embodiment, the control module 90 receives a command from an operator input device (e.g., a joystick, a touchscreen panel, etc.), such as a command to raise or lower the boom 10. In this embodiment, the control module 90 may receive other inputs, such as signals or commands, from one or more other components of the hydraulic excavator 100, processing the inputs to determine necessary actions to execute the command from the operator input device. In an exemplary embodiment, the control module 90 interprets the signals received from the pressure sensors 26 and 28, automatically opening and/or closing the valves 30, 32, and/or 34 based on a fluid pressure within the actuators 14 and 18 in order to execute the desired command. The control module 90 is described in further detail below.

The hydraulic control circuit 20 also includes pilot valve 86 and pilot valve 88. In an exemplary embodiment, the pilot valves 86 and 88 are load compensation valves (i.e., compensators) and the hydraulic control circuit 20 is part of a post-compensated load sensing system. Post-compensated load sensing systems are commonly used in mobile hydraulic machines (e.g., excavators, backhoes, wheel loaders, etc.). In this embodiment, the speed of the actuators 14 and 18 is independent of load. For example, if the operator sends simultaneous commands to actuators for controlling the stick 12 and the bucket 16 (not shown), the velocity of the stick 12 and the bucket 16 will not change with actuator position and the payload in the bucket 16. Without the pilot valves 86 and 88, the actuator with the lower fluid pressure would receive more pump flow (e.g., fluid from the hydraulic pump 110) than the other, and the division of pump flow would change with the load on the actuators as the fluid flows in the direction of least resistance. The compensator (e.g., pilot valve 86, pilot valve 88) for the actuator with the highest pressure would stay wide open in this embodiment, while the compensators for other actuators at lower pressures are partially closed, thereby restricting pump flow and compensating for the effect of different actuator loads. The load compensation is realized hydro-mechanically with a system of pilot lines and pilot operated valves in the control valve manifold.

Referring now to FIG. 3, the hydraulic control circuit 20 is shown for an operating condition where the boom 10 is raised (i.e., moved in a first direction), or in a "boom raise mode" (e.g., powered boom raise mode, boom raise configuration, etc.), according to an exemplary embodiment. In this embodiment, the boom 10 is raised by routing pressurized hydraulic fluid to the actuators 14 and 18. The pressurized fluid is routed from the hydraulic pump 110 to the actuators 14 and 18 by opening control valves 32 and 34 within the hydraulic control circuit 20. The pressurized fluid applies a force to the actuators 14 and 18, moving the actuators 14 and 18 to an extended position and thus raising the boom 10. The boom raise mode may also include other configurations of the hydraulic control circuit 20 not shown in FIG. 3, including otherwise opening or closing the valves 30, 32, and/or 34 in order to route pressurized hydraulic fluid to the head end chambers 22 and 82 of the actuators 14 and 18, respectively, in order to raise the boom 10.

In an exemplary embodiment, the force applied to the actuators 14 and 18 is determined by or otherwise related to a fluid pressure within the hydraulic control circuit 20 (i.e., at the actuators 14 and 18). Thus, the movement of the boom 10, or the speed with which the boom 10 moves (i.e., a boom velocity), may be modulated or controlled by adjusting one or more components of the hydraulic system (e.g., hydraulic control circuit 20, hydraulic pump 110, etc.) to increase or decrease the fluid pressure. In an exemplary embodiment, the fluid pressure within the hydraulic control circuit 20 is at least partially a function of the size of the fluid openings in the control valves 32 and/or 34, such that the fluid pressure may be increased or decreased by increasing or decreasing the size of the fluid openings (i.e., opening or closing the control valves 32 and/or 34), respectively. The fluid pressure may also be at least partially a function of the pump flow rate of the hydraulic pump 110, such that the fluid pressure may be increased or decreased by increasing or decreasing the pump flow rate, respectively.

In the illustrated embodiment of FIG. 3, the control module 90 sends a signal or command to the solenoids 44 and 48 in response to a command from the operator input device to raise the boom 10. The signal or command from the control module 90 sends an electric current through the solenoids 44 and 48, energizing the solenoids 44 and 48. When the solenoids 44 and 48 reach a threshold current level, the solenoids 44 and 48 generate a force that is sufficient to at least partially open the control valves 32 and 34 to allow some hydraulic fluid to pass through the control valves 32 and 34. In the illustrated embodiment of FIG. 3, the current level in the solenoids 44 and 48 is such that the control valve 32 is moved to a first open position and the control valve 34 is moved to a first open position. The control module 90 may also send a signal or command to the solenoid 50 in order to move the regeneration valve 30 to the closed position (shown in FIG. 3). In the closed position, the regeneration valve 30 substantially blocks or prevents the flow of fluid between the head end chambers 22 and 82 and the rod end chambers 24 and 84.

Once the control valves 32 and 34 are open, fluid is routed to the actuators 14 and 18. In the illustrated embodiment of FIG. 3, hydraulic fluid is routed from the hydraulic pump 110 to the hydraulic control circuit 20 through fluid line 52. From fluid line 52, the fluid is routed through fluid lines 78 and 80 through the open control valves 32 and 34, respectively. Fluid continues to flow to the closed check valves 38 and 40 until the fluid pressure at the check valves 38 and 40 reaches a threshold fluid pressure, forcing the check valves 38 and 40 to open. Once the check valves 38 and 40 are open, hydraulic fluid flows to the pilot valves 86 and 88, which have an open position (shown in FIG. 3) and a closed position (shown in FIG. 2). The pilot valves 86 and 88 are typically closed, but may be opened automatically (e.g., when the hydraulic fluid at the pilot valve 86 or 88 reaches a threshold fluid pressure). Hydraulic fluid passes through the open pilot valves 86 and 88, through fluid line 74 and fluid line 76, through fluid line 56 and fluid line 58, and into the head end chambers 22 and 82 of the actuators 14 and 18. Fluid within the rod end chambers 24 and 84 is pushed by the pistons 102 and 106 into fluid lines 60 and 62 and through fluid line 64. From there, fluid is routed to the hydraulic tank 120 to be recycled and re-used within the hydraulic control circuit 20 and/or other circuits within the hydraulic excavator 100. The fluid is either routed through fluid line 68, through the open control valve 32, and through fluid lines 72 and 54 to the hydraulic tank 120, or through fluid line 66, through the open control valve 34, and through fluid lines 70 and 54 to the hydraulic tank 120.

In the illustrated embodiment of FIG. 3, the fluid pressure at the actuators 14 and 18 may be adjusted by adjusting the electric current applied to the solenoids 44 and 48 in order to increase or decrease the size of the fluid opening within the control valves 32 and 34. In this embodiment, the control module 90 may be configured to send a command or signal to the solenoids 44 and/or 48 in order to adjust the electric current applied to the solenoids 44 and 48. When at least one of the control valves 32 and 34 are in an open position, the fluid pressure within the hydraulic control circuit 20 may also be at least partially a function of the pump flow rate of the hydraulic pump 110. In an exemplary embodiment, the control module 90 is configured to communicate with the hydraulic pump 110, sending a signal to the hydraulic pump 110 to increase or decrease the pump flow rate and thus increase or decrease the fluid pressure within the hydraulic control circuit 20.

In another embodiment, a single control valve 32 or 34 may be opened to route pressurized fluid to the actuators 14 and 18, depending on the force necessary to raise the boom 10 in the particular application. For instance, the control valve 32 may be moved to the first open position and the control valve 34 to the closed position in order to route pressurized hydraulic fluid to the head end chambers 22 and 82 for raising the boom 10. In this embodiment, fluid is routed from the hydraulic pump 110 through the open control valve 32 and to the head end chambers 22 and 82 to provide a sufficient fluid pressure at the pistons 102 and 106 to extend the actuators 14 and 18 and raise the boom 10. Fluid is routed from the rod end chambers 24 and 84 back through the open control valve 32 to the hydraulic tank 120. In this embodiment, the first control valve 32 may be opened by applying an electric current to the solenoid 44 (e.g., in response to a command from the control module 90) and the second control valve 34 may be closed by a similar command sent to the solenoid 46 or 48. The boom 10 may also be raised by opening the control valve 34 and closing the control valve 32.

Referring now to FIGS. 4 and 5, the hydraulic control circuit 20 is shown in multiple configurations or modes for lowering the boom 10 (i.e., moving the boom 10 in a second direction), according to an exemplary embodiment. In this embodiment, the hydraulic control circuit 20 includes a "powered boom lower mode" (e.g., powered boom lower configuration) in which the boom 10 is lowered using hydraulic power (shown in FIG. 4), and a "regenerating boom lower mode" (e.g., regenerating boom lower configuration) in which the boom 10 is lowered at least partially by its own weight (shown in FIG. 5). The hydraulic control circuit 20 is moved to the powered boom lower mode or the regenerating boom lower mode in order to lower the boom 10. In some embodiments, the control module 90 receives a command from the operator input device to lower the boom 10 and sends one or more signals or commands to the hydraulic control circuit 20 in response, causing the hydraulic control circuit 20 to move to the appropriate configuration or mode and the boom 10 to lower. The mode may be automatically selected by the control module 90 based on one or more conditions of the hydraulic control circuit 20, or the mode may be manually selected, such as by an operator of the hydraulic excavator 100.

In an exemplary embodiment, the mode used to lower the boom 10 is determined based on a difference between the head end fluid pressure and the rod end fluid pressure (i.e., an actuator pressure differential). In one embodiment, the actuator pressure differential is calculated by the control module 90 based on the signals received from the pressure sensors 26 and 28. In another embodiment, the actuator pressure differential is calculated by the pressure sensors 26 and 28 and included within the signals sent to the control module 90. In the illustrated embodiment of FIGS. 4 and 5, if the actuator pressure differential is greater than a specified regeneration pressure threshold (i.e., specified pressure threshold, pressure differential threshold, etc.) then the control module 90 sends one or more signals or commands to move the hydraulic control circuit 20 to the regenerating boom lower mode in order to lower the boom 10. If the actuator pressure differential is less than or equal to the specified regeneration pressure threshold, then the control module 90 sends one or more signals or commands to move the hydraulic control circuit 20 to the powered boom lower mode in order to lower the boom 10. The actuator pressure differential may be calculated in any manner suitable for the particular application of the hydraulic control circuit 20, including by regularly calculating a moving average for the head end fluid pressure and the rod end fluid pressure and calculating the actuator pressure differential based on the moving averages. The specified regeneration pressure threshold may be any value suitable for the particular application of the hydraulic control circuit 20, including a predetermined value programmed or entered into the control module 90, or a value calculated based on one or more conditions of the hydraulic excavator 100. The specified regeneration pressure threshold may be variable or constant. The actuator pressure differential and the specified regeneration pressure threshold are discussed in further detail below in reference to control algorithm 700 shown in FIG. 7.

In the illustrated embodiment of FIG. 4, the hydraulic control circuit 20 is shown in the powered boom lower mode, in which the boom 10 is lowered using hydraulic power. In the powered boom lower mode, the hydraulic control circuit 20 routes pressurized hydraulic fluid to the actuators 14 and 18, providing hydraulic power to the boom 10. The pressurized fluid is routed from the hydraulic pump 110 to the actuators 14 and 18 by opening the control valve 34, and by closing the control valve 32 and the regeneration valve 30. The pressurized fluid is routed to the rod end chambers 24 and 84, applying a force to move the actuators 14 and 18 (i.e., the pistons 102 and 106) from the extended position to a retracted position in order to lower the boom 10. The powered boom lower mode may also include other configurations of the hydraulic control circuit 20 not shown in FIG. 4, including otherwise opening or closing the valves 30, 32, and/or 34 in order to route pressurized hydraulic fluid to the rod end chambers 24 and 84 of the actuators 14 and 18, respectively, in order to lower the boom 10.

In an exemplary embodiment, the force applied to the actuators 14 and 18 is determined by or otherwise related to a fluid pressure within the hydraulic control circuit 20 (i.e., at the actuators 14 and 18). The speed with which the boom 10 is lowered (i.e., a boom lower velocity) may thus be modulated or controlled by adjusting one or more components of the hydraulic system (e.g., hydraulic control circuit 20, hydraulic pump 110, etc.) to increase or decrease the fluid pressure at the actuators 14 and 18. In the illustrated embodiment of FIG. 4, the fluid pressure at the actuators 14 and 18 (and thus the boom lower velocity) is at least partially a function of the size of the fluid opening within the open control valve 34. In this embodiment, the boom lower velocity may be increased by increasing the size of the fluid opening within control valve 34 and decreased by decreasing the size of the fluid opening within control valve 34. The fluid pressure may also be at least partially a function of the pump flow rate of the hydraulic pump 110, such that the fluid pressure and boom lower velocity may be increased or decreased by increasing or decreasing the pump flow rate, respectively.

In other embodiments, the fluid pressure (and thus the boom lower velocity) may be increased and/or decreased in another manner suitable for the particular application of the hydraulic control circuit 20 and/or the hydraulic excavator 100.

In order to open the control valve 34, the control module 90 sends a signal or command to increase the electric current through the solenoid 46, energizing the solenoid 46. When the solenoid 46 reaches a threshold current level, the solenoid 46 generates a force that is sufficient to at least partially open the control valve 34 to allow hydraulic fluid to pass through the control valve 34. In the illustrated embodiment of FIG. 4, the current level in the solenoid 46 is such that the control valve 34 is moved to a second open position. In an exemplary embodiment, the fluid velocity may be adjusted by modulating the electric current applied to the solenoid 46 in order to increase or decrease the size of the fluid opening within the control valve 34. In this embodiment, the control module 90 may be configured to send a command or signal to the solenoid 46 in order to modulate the electric current applied to the solenoid 46 and increase or decrease the size of the fluid opening within the control valve 34. The fluid pressure within the hydraulic control circuit 20 may also be at least partially a function of the pump flow rate of the hydraulic pump 110. In an exemplary embodiment, the control module 90 is configured to communicate with the hydraulic pump 110, sending a signal to the hydraulic pump 110 to increase or decrease the pump flow rate and thus increase or decrease the fluid pressure within the hydraulic control circuit 20.

The control module 90 also causes the control valve 32 and the regeneration valve 30 to close when the hydraulic control circuit 20 is in the powered boom lower mode. If the control valve 32 is open, the control module 90 reduces the electric current through solenoids 42 and/or 44 in order to move the control valve 32 to the closed position. The control module 90 may send a signal or command to the solenoids 42 and/or 44 or discontinue a previous signal or command sent to the solenoids 42 and/or 44 in order to reduce the electric current through the solenoids 42 and/or 44 and close the control valve 32. If the regeneration valve 30 is open, the control module 90 reduces the electric current through solenoid 50 by sending a signal or command to the solenoid 50 or by discontinuing a signal or command previously sent to the solenoid 50 in order to close the regeneration valve 30.

Once the control valve 34 is open and the control valve 32 and regeneration valve 30 are closed, pressurized hydraulic fluid is routed to the rod end chambers 24 and 84 of the actuators 14 and 18. In the illustrated embodiment of FIG. 4, the fluid is routed from the hydraulic pump 110 to the hydraulic control circuit 20 through fluid line 52. From fluid line 52, the fluid is routed by fluid line 80 through the open control valve 34. The fluid flows through the open control valve 34 to the closed check valve 40 until the fluid pressure at the check valve 40 reaches a threshold fluid pressure, forcing the check valve 40 to open. Once the check valve 40 is open, the hydraulic fluid flows to the pilot valve 88. In this embodiment, the pilot valve 88 is opened when the pressure of the hydraulic fluid from the fluid line 80 reaches a threshold fluid pressure. Once the pilot valve 88 is open, the hydraulic fluid passes through the open pilot valve 88 and back through the open control valve 34 through fluid line 66. From fluid line 66, the fluid flows through fluid line 64 and through fluid line 60 and fluid line 62 to rod end chambers 24 and 84, respectively. In an exemplary embodiment, the pressure of the hydraulic fluid provides hydraulic power to the boom 10, forcing the actuators 14 and 18 to retract and thus lowering the boom 10. When the actuators 14 and 18 retract, the pistons 102 and 106 force fluid from the head end chambers 22 and 82 to the hydraulic tank 120. The fluid is routed through the fluid lines 56 and 58, through fluid line 76, through the open control valve 34 (i.e., in the second open position), and through fluid lines 70 and 54 to the hydraulic tank 120. The closed regeneration valve 30 substantially blocks the flow of fluid between the head end chambers 22 and 82 and the rod end chambers 24 and 84. When control valve 32 is closed, the control valve 32 substantially prevents fluid from the hydraulic pump 110 from traveling to the actuators 14 and 18 through the control valve 32.

The boom 10 may also be lowered in powered boom lower mode by opening both of the control valves 32 and 34 and closing the regeneration valve 30. In one embodiment, the boom 10 is lowered by moving the control valve 32 to a second open position (shown in FIG. 5) and moving the control valve 34 to the second open position (shown in FIG. 4). In this embodiment, pressurized fluid is routed from the hydraulic pump 110 to the rod end chambers 24 and 84 by the open control valve 34, and return fluid from the head end chambers 22 and 82 is routed to the hydraulic tank 120 through both open control valves 32 and 34. The control valve 32 does not fluidly connect the hydraulic pump 110 to the actuators 14 and 18 in this embodiment, but rather connects the actuators 14 and 18 (i.e., the head end chambers 22 and 82) to the hydraulic tank 120.

In the illustrated embodiment of FIG. 5, the hydraulic control circuit 20 is shown in the regenerating boom lower mode. In the regenerating boom lower mode, the actuators 14 and 18 are fluidly disconnected from the hydraulic pump 110 and the boom 10 may be lowered without receiving additional fluid from the hydraulic pump 110. Rather, the boom 10 is lowered by routing fluid to the rod end chambers 24 and 84 from within the hydraulic control circuit 20. In an exemplary embodiment, the pump flow rate of the hydraulic pump 110 is reduced in regenerating boom lower mode, reducing the energy required to lower the boom 10. The regenerating boom lower mode may also include other configurations of the hydraulic control circuit 20 not shown in FIG. 5, including otherwise opening or closing the valves 30, 32, and/or 34 in order to route hydraulic fluid within the hydraulic control circuit 20 to the rod end chambers 24 and 84 of the actuators 14 and 18, respectively, in order to lower the boom 10.

In an exemplary embodiment, the regeneration valve 30 is in an open position and the hydraulic control circuit 20 routes pressurized hydraulic fluid from the head end chambers 22 and 82 to the rod end chambers 24 and 84 through the open regeneration valve 30 in order to lower the boom 10 in the regenerating boom lower mode. When the pressurized fluid is routed away from the head end chambers 22 and 82, the force applied at the head end chambers 22 and 82 to extend the actuators 14 and 18 (i.e., holding up the boom 10) is reduced, allowing the boom 10 to lower at least partially by its own weight. The pressurized fluid routed to the rod end chambers 24 and 84 provides a force at the rod end chambers 24 and 84 to further retract the actuators 14 and 18 in order to lower the boom 10. In the regenerating boom lower mode, the movement of the boom 10 may be modulated or otherwise controlled by adjusting the size of the fluid opening in the regeneration valve 30, increasing or decreasing the rate at which pressurized fluid flows from the head end chambers 22 and 82 to the rod end chambers 24 and 84. As this rate increases, the speed at which the boom 10 lowers is increased, and as the rate decreases the speed at which the boom 10 lowers is decreased.

In the regenerating boom lower mode, the hydraulic control circuit 20 is fluidly disconnected from the hydraulic pump 110 by at least partially closing the control valves 32 and 34. When the boom 10 is lowered using pressurized hydraulic fluid from the hydraulic pump 110 for instance, the fluid is routed from the hydraulic pump 110 through the fluid line 80 and a fluid opening of the control valve 34. However, in the regenerating boom lower mode, the control valve 34 is in the closed position, substantially blocking the fluid opening of the control valve 34 at the fluid line 80. The closed control valve 34 substantially prevents hydraulic fluid from the hydraulic pump 110 from entering the hydraulic control circuit 20 through the control valve 34, thus substantially fluidly disconnecting the fluid line 80 from the rest of the hydraulic control circuit 20 (including the actuators 14 and 18). Although the control valve 32 is in a second open position in the regenerating boom lower mode in order to allow excess fluid from the actuators 14 and 18 to exit the hydraulic control circuit 20 to the hydraulic tank 120, the control valve 32 substantially blocks the fluid opening of the control valve 32 at the fluid line 78. In this way, the control valve 32 substantially prevents hydraulic fluid from the hydraulic pump 110 from entering the hydraulic control circuit 20 through the control valve 32, thus substantially fluidly disconnecting the fluid line 78 from the rest of the hydraulic control circuit 20 (including the actuators 14 and 18). Thus, additional pressurized fluid from the hydraulic pump 110 is substantially prevented from entering the hydraulic control circuit 20 and reaching the actuators 14 and 18 when the hydraulic control circuit 20 is in the regenerating boom lower mode, substantially fluidly disconnecting the actuators 14 and 18 from the hydraulic pump 110. As a result, the hydraulic pump 110 is not required to pump pressurized hydraulic fluid to the hydraulic control circuit 20 in this mode and the energy required to lower the boom 10 may be reduced. The regeneration valve 30 is fluidly connected to the hydraulic tank 120 by fluid lines 74 and 72 in this embodiment. Excess hydraulic fluid is routed through fluid lines 74 and 72 and through the open control valve 32, such that a separate return tank line is not required.

If the control valve 34 is in an open position, the control module 90 reduces the electric current through the solenoids 42 and/or 44 in order to move the control valve 34 to the closed position. In one embodiment, the control module 90 sends a signal or command to decrease the electric current through the solenoids 42 and/or 44. In another embodiment, the control module 90 removes or discontinues a previous signal or command that was sent to increase the electric current, thus reducing the electric current through the solenoids 42 and/or 44. When the electric current within the solenoids 42 and/or 44 lowers below a threshold current level, the control valve 34 is allowed to move to the closed position of FIG. 5, preventing hydraulic fluid from passing through the control valve 34.

In order to move the control valve 32 to the second open position of FIG. 5, the control module 90 sends a signal or command to increase the electric current through the solenoid 42, energizing the solenoid 42. When the solenoid 42 reaches a threshold current level, the solenoid 42 generates a force that is sufficient to at least partially open the control valve 32. In the illustrated embodiment of FIG. 5, the current level in the solenoid 42 is such that the control valve 32 is moved to the second open position. In the second open position, a fluid opening is created within the control valve 32 to fluidly connect the head end chambers 22 and 82 to the hydraulic tank 120, allowing fluid to travel through the hydraulic control circuit 20 from the head end chambers 22 and 82 to the hydraulic tank 120. In an exemplary embodiment, the fluid velocity may be adjusted by modulating the electric current applied to the solenoid 42 in order to increase or decrease the size of the fluid opening within the control valve 32. In this embodiment, the control module 90 may be configured to send a command or signal to the solenoid 42 in order to modulate the electric current applied to the solenoid 42 and increase or decrease the size of the fluid opening within the control valve 32. In the second open position, the control valve 32 also closes the fluid opening used to fluidly connect the actuators 14 and 18 to the hydraulic pump 110 (i.e., the fluid opening at fluid line 78).

Once the regeneration valve 30 is open, the control valve 34 is closed, and the control valve 32 is in the second open position, hydraulic fluid is routed from the head end chambers 22 and 82 to the rod end chambers 24 and 84, and excess hydraulic fluid is routed to the hydraulic tank 120. In the illustrated embodiment of FIG. 5, the fluid is routed from the head end chambers 22 and 82 through the fluid lines 56 and 58, respectively, and through the open regeneration valve 30. Hydraulic fluid builds at check valve 36 until the fluid pressure at the check valve 36 reaches a threshold fluid pressure, opening the check valve 36 and allowing hydraulic fluid to flow through fluid lines 60 and 62 to the rod end chambers 24 and 84, respectively. The rod end chambers 24 and 84 of the actuators 14 and 18 receive hydraulic fluid from the head end chambers 22 and 82 as necessary to lower the boom 10 at the speed indicated or desired based on input from the operator input device. Fluid routed from the head end chambers 22 and 82 that is not required to lower the boom 10 (i.e., retract the actuators 14 and 18) is routed from fluid lines 56 and 58 to fluid line 74, through the open control valve 32, and through fluid lines 72 and 54 to the hydraulic tank 120. The regeneration valve 30 is fluidly connected to the hydraulic tank 120 by fluid lines 74 and 72 and the open control valve 32 in this embodiment, such that the regeneration valve 30 does not require a separate tank return line in order to return hydraulic fluid to the hydraulic tank 120.

Referring now to FIG. 6, a block diagram of the control module 90 is shown, according to an exemplary embodiment. The control module 90 may be used to control the movement and/or operation of the boom 10 by controlling one or more components of the hydraulic control circuit 20 (e.g., regeneration valve 30, control valve 32, control valve 34, etc.). The control module 90 includes a processor 92 and memory 94. Memory 94 stores programming instructions that, when executed by processor 92, control the hydraulic control circuit 20, including the various components of the hydraulic control circuit 20. Memory 94 may also be used to store fluid pressure information received from the pressure sensors 26 and 28, or any other signals, commands, or other information related to the hydraulic control circuit 20 or any other components of the hydraulic excavator 100. The control module 90 may be in electrical communication with the regeneration valve 30, the control valve 32, the control valve 34, and/or the hydraulic pump 110 in order to send one or more signals or commands to these components. For instance, the control module 90 may be used to send signals to one or more of the solenoids 42, 44, 46, 48, and/or 50 in order to open or close one or more of the regeneration valve 30, the control valve 32, and/or the control valve 34.

The control module 90 receives operational electrical power from a power supply 96. The power supply 96 provides power to the control module 90 and may also provide power to one or more other components of the hydraulic excavator 100, including the hydraulic pump 110 and the hydraulic control circuit 20. The power supply 96 may be any suitable power source, including, but not limited to, a diesel engine, a generator, a solar power source, grid power, or a combination thereof. In an exemplary embodiment, the power supply 96 provides power to the hydraulic pump 110, such that when the hydraulic pump 110 is not in use less energy or power is used from the power supply 96.

Figure 7:
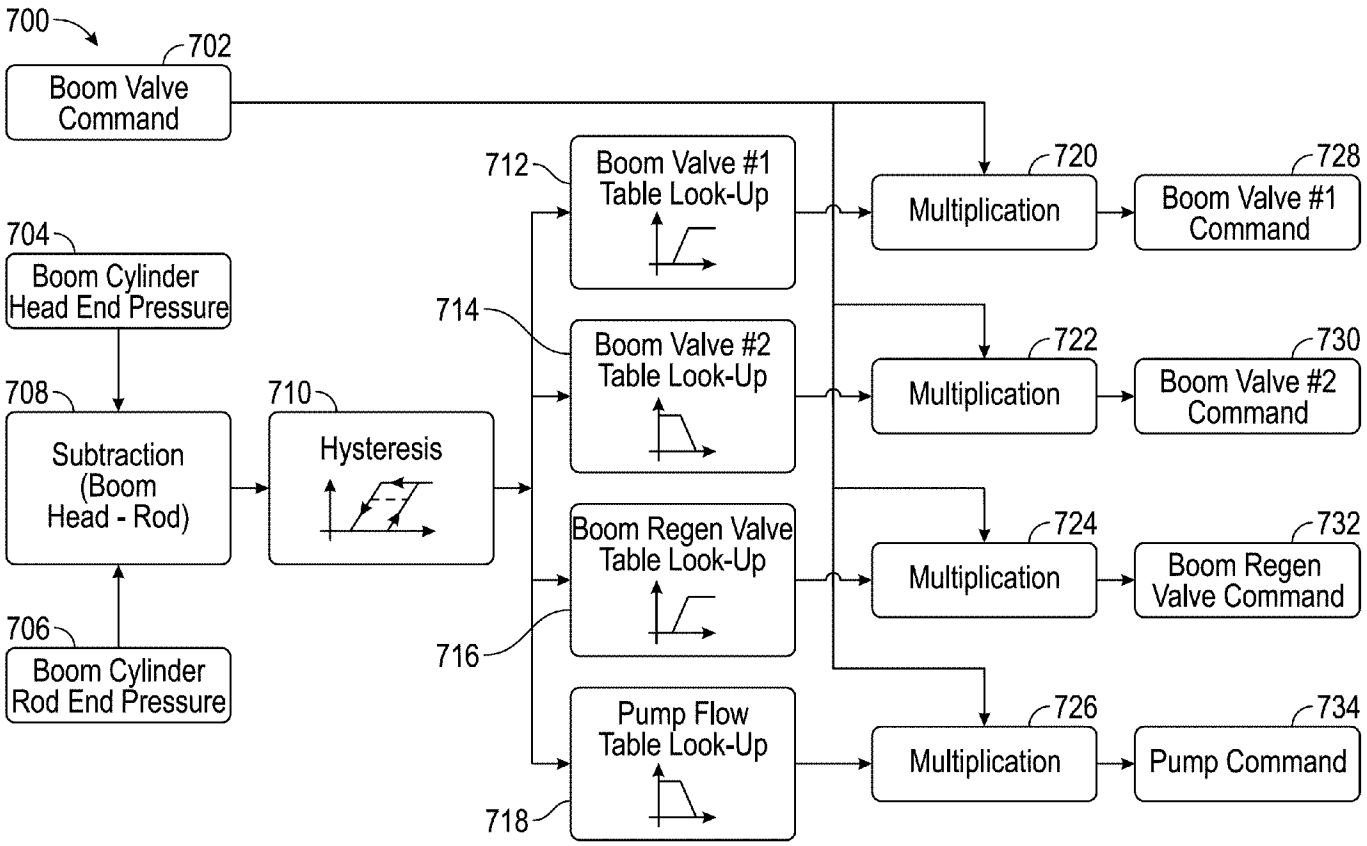
FIG. 7 is a flow chart representation of an algorithm for controlling the hydraulic circuit of FIG. 2, according to an exemplary embodiment.

Referring now to FIG. 7, a flow chart representation of a control algorithm 700 for controlling the hydraulic control circuit 20 is shown, according to an exemplary embodiment. The control algorithm 700 may be used by the control module 90 to control the hydraulic control circuit 20 in order to lower the boom 10 most efficiently. According to the illustrated embodiment, at 702 the control module 90 receives a signal or command (e.g., a "boom valve command") from an operator (e.g., via the operator input device) to lower the boom 10. The boom valve command may include a magnitude of desired movement for the boom 10 (i.e., a movement velocity), such as a boom velocity or speed. At 704, the control module 90 receives signals from the pressure sensor 26 (e.g., when operator input is received, at regular intervals, continuously, etc.) representing the fluid pressure in the head end chambers 22 and 82. At 706, the control module 90 receives signals from the pressure sensor 28 (e.g., when operator input is received, at regular intervals, continuously, etc.) representing the fluid pressure in the rod end chambers 24 and 84. In this embodiment, at 708 the control module 90 uses the signals from the pressure sensors 26 and 28 to calculate an actuator pressure differential (i.e., a difference between the head end fluid pressure and the rod end fluid pressure) at a particular time. The control module 90 may calculate the pressure differential at regular intervals, upon receiving a command from the operator, continuously as signals are received from the pressure sensors 26 and 28, or in any other manner as may be suitable for the particular application of the hydraulic control circuit 20 and/or the control algorithm 700. The pressure differential(s) may be stored on a memory device such as memory 94, or otherwise stored or used, as may be suitable for the particular application of the hydraulic control circuit 20.

At 710, the control algorithm 700 includes a hysteresis algorithm (e.g., a hysteresis smoothing algorithm) for preventing the hydraulic control circuit 20 from frequently alternating between the two boom lowering modes. In this embodiment, the control module 90 is programmed to calculate the actuator pressure differential and select the boom lowering mode based on the actuator pressure differential when the boom valve command is received. In an exemplary embodiment, the control module 90 causes the hydraulic control circuit 20 to move to the powered boom lower mode or configuration when the actuator pressure differential is greater than a specified regeneration pressure threshold, and to move to the regenerating boom lower mode or configuration when the actuator pressure differential is less than or equal to the specified regeneration pressure threshold. The specified regeneration pressure threshold may be determined based on one or more conditions of the hydraulic excavator 100 and/or the hydraulic control circuit 20, or may be predetermined based on the specifications of the hydraulic excavator 100 and/or the hydraulic control circuit 20. When the boom valve command is received, the boom lower mode is selected based on the actuator pressure differential. The hysteresis algorithm prevents the boom lower mode from changing unnecessarily as new fluid pressures are received. In an exemplary embodiment, once the powered boom lower mode is selected, the hysteresis algorithm maintains the powered boom lower mode until the actuator pressure differential lowers below a minimum pressure differential having a lower value than the specified pressure differential. If the regenerating boom lower mode is selected, the hysteresis algorithm maintains the regenerating boom lower mode until the actuator pressure differential rises above a maximum pressure differential having a greater value than the specified pressure differential. The minimum and maximum pressure differentials may be based on a percentage of the specified pressure differential, or may be otherwise calculated or determined based on what is suitable for the particular application of the hydraulic control circuit 20. In other embodiments, the hysteresis algorithm may otherwise generate a lag between the input (e.g., operator input) and the related output (e.g., lowering of the boom 10), such as to allow the boom control algorithm 700 to process one or more conditions of the hydraulic excavator 100 in order to lower the boom 10 in the most efficient mode.

At 712, 714, 716, and 718 of the control algorithm 700, the control module 90 performs a table look-up step for each of the control valve 32, the control valve 34, the regeneration valve 30, and the hydraulic pump 110, respectively. In an exemplary embodiment, the control module 90 receives signals from the valves 30, 32, and 34 and the hydraulic pump 110 to determine the current state of the component, such as the position of the valves 30, 32, and 34 (e.g., size of the respective fluid openings, percent open or closed, fluid pressure at the valves, etc.) or the flow rate of the hydraulic pump 110. This information is used as part of the control algorithm 700 to determine the necessary steps or movements to execute the boom valve command.

At 720, 722, 724, and 726 of the control algorithm 700, the control module 90 uses the information from the table look-up steps 712, 714, 716, and 718 and the boom valve command to determine the appropriate command to send to each of the control valve 32, the control valve 34, the regeneration valve 30, and the hydraulic pump 110. For instance, if the actuator pressure differential is less than or equal to the specified regeneration pressure threshold, the control module 90 may determine the current position or state of each of the components 30, 32, 34, and 110 and send a command to the components 30, 32, 34, and 110 to move the components 30, 32, 34, and 110 to the configuration shown in FIG. 5 (i.e., regenerating boom lower mode). On the other hand, if the actuator pressure differential is greater than the specified regeneration pressure threshold, the control module 90 may send a command to the components 30, 32, 34, and 110 to move the components 30, 32, 34, and 110 to the configuration shown in FIG. 4 (i.e., powered boom lower mode).

At 728, 730, 732, and 734 of the control algorithm 700, the control module 90 sends a command to move or otherwise control the regeneration valve 30, the control valves 32 and 34, and the hydraulic pump 110 so that the boom 10 is lowered in the appropriate or desired mode. In an exemplary embodiment, the control module 90 causes an electric current to be send to one or more of the solenoids 42, 44, 46, 48, and/or 50 in order to open or close the associated valve 30, 32, and/or 34 such that the hydraulic control circuit 20 is moved or controlled to the desired configuration to perform the boom function. When the boom 10 is lowered using powered boom lower mode (e.g., when the operator sends a command to lower the boom 10 and the pressure differential between the rod end chambers 24 and 84 and the head end chambers 22 and 82 is greater than the specified regeneration pressure threshold), the control module 90 sends a signal or command to one or more of solenoids 42, 44, 46, 48, and/or 50 in order to move the control valve 32 to the closed position, the control valve 34 to the second open position, and the regeneration valve 30 to a closed position (e.g., the configuration shown in FIG. 4). When the boom 10 is lowered using regenerating boom lower mode (e.g., when the operator sends a command to lower the boom 10 and the pressure differential between the rod end chambers 24 and 84 and the head end chambers 22 and 82 is less than or equal to the specified regeneration pressure threshold), the control module 90 sends a signal or command to one or more of solenoids 42, 44, 46, 48, and/or 50 in order to move the control valve 32 to the second open position, the control valve 34 to the closed position, and the regeneration valve 30 to an open position (e.g., the configuration shown in FIG. 5).

The construction and arrangement of the hydraulic control circuit, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed hydraulic control circuit may be implemented into any hydraulic machine in order to control one or more components of the hydraulic machine. The disclosed hydraulic control circuit is intended to provide a regenerative function for a hydraulic component, routing fluid between ends of an actuator and reducing the energy or fuel required to move a hydraulic component. The disclosed hydraulic control circuit is also intended to disconnect the associated actuator from the fluid source as part of the regenerative function, further reducing the energy or fuel required to move the hydraulic component when other components are in use. The disclosed hydraulic control circuit is also intended to provide an automatic regenerative function that operates based on conditions within the hydraulic machine to improve energy efficiency of the machine. In addition, the disclosed hydraulic control circuit is intended to provide the above benefits without the use of a separate fluid line connecting the regeneration valve to a return tank, reducing the number of necessary components and thus the associated costs.

It will be apparent to those skilled in the art that various modifications and variations can be made to the disclosed hydraulic control circuit. Other embodiments will be apparent to those skilled in the art from consideration of the specification and practice of the disclosed hydraulic control circuit. It is intended that the specification and examples be considered as exemplary only, with a true scope being indicated by the following claims and their equivalents.

What is claimed is:

1. A hydraulic circuit for controlling a component of a hydraulic machine, the hydraulic circuit comprising:

an actuator having a head end chamber and a rod end chamber, the actuator having an extended position for moving the component in a first direction and a retracted position for moving the component in a second direction;

a regeneration valve having an open position for fluidly connecting the head end chamber to the rod end chamber and a closed position for fluidly disconnecting the head end chamber and the rod end chamber;

a first control valve having a first open position for fluidly connecting the head end chamber to a fluid source and fluidly connecting the rod end chamber to a return tank, a second open position for fluidly connecting the head end chamber and the regeneration valve to the return tank and fluidly disconnecting the rod end chamber from the fluid source, and a closed position for fluidly disconnecting the rod end chamber from the fluid source and the return tank; and a second control valve having a first open position for fluidly connecting the head end chamber to the fluid source and fluidly connecting the rod end chamber to the return tank, a second open position for fluidly connecting the rod end chamber to the fluid source and the head end chamber to the return tank, and a closed position for fluidly disconnecting the rod end chamber from the fluid source and the return tank.

2. The hydraulic circuit of claim 1, wherein the actuator is moved toward the extended position in response to pressurized fluid from the fluid source when the first control valve is in the first open position and the second control valve is in the first open position or the closed position, or when the first control valve is in the closed position and the second control valve is in the first open position, and wherein the actuator is moved toward the retracted position in response to pressurized fluid from the fluid source when the first control valve is in the closed position or the second open position and the second control valve is in the second open position.

3. The hydraulic circuit of claim 2, wherein the actuator is moved toward the retracted position in response to pressurized fluid routed from the head end chamber to the rod end chamber through the regeneration valve when the first control valve is in the second open position, the second control valve is in the closed position, and the regeneration valve is in the open position.

4. The hydraulic circuit of claim 3, further comprising:

a control module configured to receive a command from an operator input device and programmed to control a movement of the regeneration valve, the first control valve, and the second control valve based on the command.

5. The hydraulic circuit of claim 4, wherein the control module is programmed to modulate a movement of the component in response to the command by controlling the movement of the regeneration valve, the first control valve, and the second control valve.

6. The hydraulic circuit of claim 4, further comprising:

a sensor assembly fluidly connected to the head end chamber for monitoring a first fluid pressure and fluidly connected to the rod end chamber for monitoring a second fluid pressure;

wherein the sensor assembly is configured to transmit one or more signals based on the first fluid pressure and the second fluid pressure.

7. The hydraulic circuit of claim 6, wherein the control module is configured to receive the one or more signals from the sensor assembly and programmed to calculate an actuator pressure differential based on the one or more signals.

8. The hydraulic circuit of claim 7, wherein the control module is programmed to:

when the command comprises moving the component in the first direction, move the regeneration valve to the closed position and execute one of the following: move the first control valve to the first open position and the second control valve to the first open position, move the first control valve to the first open position and the second control valve to the closed position, or move the first control valve to the closed position and the second control valve to the first open position;

when the command comprises moving the component in the second direction and the actuator pressure differential is greater than a specified regeneration pressure threshold, move the first control valve to the second open position, the second control valve to the closed position, and the regeneration valve to the open position; and when the command comprises moving the component in the second direction and the actuator pressure differential is less than or equal to the specified regeneration pressure threshold, move the first control valve to the closed position or the second open position, the second control valve to the second open position, and the regeneration valve to the closed position.

9. An apparatus having a hydraulic component movable in a first direction and a second direction, the apparatus comprising:

an actuator coupled to the hydraulic component and having a head end chamber and a rod end chamber, the actuator having an extended position for moving the hydraulic component in the first direction and a retracted position for moving the hydraulic component in the second direction;

a fluid source for selectively providing pressurized fluid to the actuator;

a hydraulic circuit for fluidly connecting the fluid source to the actuator, the hydraulic circuit comprising:

a regeneration valve having an open position for fluidly connecting the head end chamber to the rod end chamber and a closed position for blocking a fluid flow between the head end chamber and the rod end chamber;

a first control valve having a first open position for fluidly connecting the head end chamber to the fluid source and fluidly connecting the rod end chamber to a return tank, a second open position for fluidly connecting the head end chamber and the regeneration valve to the return tank and fluidly disconnecting the rod end chamber from the fluid source, and a closed position for fluidly disconnecting the rod end chamber from the fluid source and the return tank; and a second control valve having a first open position for fluidly connecting the head end chamber to the fluid source and fluidly connecting the rod end chamber to the return tank, a second open position for fluidly connecting the rod end chamber to the fluid source and the head end chamber to the return tank, and a closed position for fluidly disconnecting the rod end chamber from the fluid source and the return tank.

10. The apparatus of claim 9, wherein the actuator is moved toward the extended position in response to pressurized fluid from the fluid source when the first control valve is in the first open position and the second control valve is in the first open position or the closed position, and when the first control valve is in the closed position and the second control valve is in the first open position, and wherein the actuator is moved toward the retracted position in response to pressurized fluid from the fluid source when the first control valve is in the closed position or the second open position and the second control valve is in the second open position.

11. The apparatus of claim 10, wherein the actuator is moved toward the retracted position in response to pressurized fluid routed from the head end chamber to the rod end chamber through the regeneration valve when the first control valve is in the second open position, the second control valve is in the closed position, and the regeneration valve is in the open position.

12. The apparatus of claim 9, further comprising:

an operator input device for transmitting a command to move the hydraulic component in the first direction or the second direction; and a control module configured to receive the command from the operator input device and programmed to control movement of the hydraulic circuit based on the command.

13. The apparatus of claim 12, wherein the control module is programmed to modulate a movement of the hydraulic component in response to the command by controlling the movement of the hydraulic circuit.

14. The apparatus of claim 13, wherein the control module is programmed to modulate the movement of the hydraulic component in response to the command by controlling a flow rate of the fluid source.

15. The apparatus of claim 12, further comprising:

a sensor assembly fluidly connected to the head end chamber for monitoring a first fluid pressure and fluidly connected to the rod end chamber for monitoring a second fluid pressure;

wherein the sensor assembly is configured to transmit one or more signals based on the first fluid pressure and the second fluid pressure.

16. The apparatus of claim 15, wherein the control module is configured to receive the one or more signals from the sensor assembly and programmed to calculate an actuator pressure differential based on the one or more signals.

17. The apparatus of claim 16, wherein the control module is programmed to:

when the command comprises moving the hydraulic component in the first direction, move the regeneration valve to the closed position and execute one of the following: move the first control valve to the first open position and the second control valve to the first open position, move the first control valve to the first open position and the second control valve to the closed position, or move the first control valve to the closed position and the second control valve to the first open position;

when the command comprises moving the hydraulic component in the second direction and the actuator pressure differential is greater than a specified regeneration pressure threshold, move the first control valve to the second open position, move the second control valve to the closed position, move the regeneration valve to the open position, and reduce a pump flow rate of the fluid source; and when the command comprises moving the hydraulic component in the second direction and the actuator pressure differential is less than or equal to the specified regeneration pressure threshold, move the first control valve to the closed position or the second open position, move the second control valve to the second open position, and move the regeneration valve to the closed position.

* * * * *